US007918248B2

(12) United States Patent
Beernaert

(10) Patent No.: US 7,918,248 B2
(45) Date of Patent: Apr. 5, 2011

(54) COMPONENT FOR A SHED-FORMING APPARATUS AND WEAVING MACHINE

(75) Inventor: Bart Beernaert, Boezinge (BE)

(73) Assignee: Picanol N.V., Ieper (BE)

( * ) Notice: Subject to any disclaimer, the term of this patent is extended or adjusted under 35 U.S.C. 154(b) by 42 days.

(21) Appl. No.: 11/632,211

(22) PCT Filed: Jul. 13, 2005

(86) PCT No.: PCT/EP2005/007598

§ 371 (c)(1),
(2), (4) Date: Mar. 2, 2007

(87) PCT Pub. No.: WO2006/005599

PCT Pub. Date: Jan. 19, 2006

(65) Prior Publication Data

US 2008/0092978 A1 Apr. 24, 2008

(30) Foreign Application Priority Data

Jul. 14, 2004 (BE) ..... 2004/0347

(51) Int. Cl.
*D03D 51/28* (2006.01)
*D03D 49/50* (2006.01)
*D03D 23/00* (2006.01)

(52) U.S. Cl. ..... 139/1 B; 139/55.1; 139/62

(58) Field of Classification Search ..... 139/1 B, 139/1 E, 55.1, 62, 66 A, 455, 103, 109
See application file for complete search history.

(56) References Cited

U.S. PATENT DOCUMENTS

| | | | | |
|---|---|---|---|---|
| 4,326,566 | A * | 4/1982 | Lampaert | 139/453 |
| 5,029,616 | A * | 7/1991 | Deconnick | 139/110 |
| 5,056,566 | A * | 10/1991 | Salomez | 139/452 |
| 5,139,053 | A | 8/1992 | Yokoi | |
| 5,265,650 | A | 11/1993 | Vinciguerra | |
| 5,388,618 | A * | 2/1995 | Decock | 139/1 R |
| 5,642,757 | A | 7/1997 | Froment et al. | |
| 5,645,111 | A | 7/1997 | Lindblom | |
| 5,743,305 | A * | 4/1998 | Tamura et al. | 139/1 E |
| 6,273,150 | B1 * | 8/2001 | Shaw et al. | 139/435.1 |
| 6,293,315 | B1 | 9/2001 | Froment et al. | |
| 6,707,267 | B2 * | 3/2004 | Bilcke | 318/432 |
| 7,110,847 | B2 * | 9/2006 | Ostyn | 700/140 |

FOREIGN PATENT DOCUMENTS

| | | | |
|---|---|---|---|
| CN | 1083549 | A | 3/1994 |
| EP | 0 493 868 | A1 | 1/1991 |
| EP | 0 542 350 | A1 | 11/1992 |

(Continued)

OTHER PUBLICATIONS

Official Action from China State I.P.O. Regarding Chinese Patent Application No. 200480023528, Jun. 2, 2010.
Examination Report (abstract) of JPO regarding Japense Patent Application No. 2007-520742, Nov. 5, 2010.

*Primary Examiner* — Bobby H Muromoto, Jr.
(74) *Attorney, Agent, or Firm* — Bacon & Thomas PLLC

(57) ABSTRACT

A shed-forming component (1, 3, 4, 24, 25, 26, 27, 28) of a shed-forming apparatus includes an information source (12, 16, 17, 18, 23, 29, 33) which may be connected to a control unit (13) for transmitting data about the specification of the component and/or data about operating parameters of the component during weaving to a control unit (13).

9 Claims, 4 Drawing Sheets

FOREIGN PATENT DOCUMENTS

| | | | |
|---|---|---|---|
| EP | 0 761 856 | A | 3/1997 |
| EP | 0 774 538 | A1 | 5/1997 |
| FR | 2 660 672 | A1 | 4/1990 |
| JP | 08-311740 | | 11/1996 |
| WO | WO 93/25740 | A | 12/1993 |
| WO | 2004/033776 | A1 | 4/2004 |

* cited by examiner

COMPONENT FOR A SHED-FORMING APPARATUS AND WEAVING MACHINE

BACKGROUND OF THE INVENTION

A. Field

The invention relates to a component for a shed-forming apparatus for a weaving machine and to a weaving machine comprising a shed-forming apparatus.

B. Technical Related Information

In weaving machines, a shed-forming apparatus is used for forming sheds in which weft yarns are inserted. The shed-forming apparatus may comprise at least two heald frames which heald frames and the driving rods for these heald frames play an important part in forming a shed and the geometry of the shed. Nowadays, the heald frames are driven by a drive mechanism, such as a dobby, a cambox, an excenter mechanism or any other drive mechanism. The law of motion, the course of motion and the positions of the heald frames and of the drive rods for the heald frames are the result of mechanical settings, which are usually not determined in dependency on the heald frame.

In fast weaving machines, the heald frames are usually a speed-limiting machine part because of fractures of the heald frame as a result of mechanical loads. It is known to select the maximum weaving speed for a heald frame based on a limited number of settings of weaving parameters, more particularly, based on empirical values, the weaving parameters are used to estimate the load on the heald frames. This indirect and inaccurate way of determining the load of the heald frames requires a large safety margin in order to prevent all kinds of fractures in heald frames, heddles, drive rods for the heald frames and the drive mechanism. As a result hereof, weaving rarely or never takes place at the maximum weaving speed at which the heald frame can still be used safely.

BRIEF SUMMARY OF DISCLOSURE

On the other hand, an overload of a heald frame may not always be detected in time, resulting in permanent damage or fractures in the heald frame, the heddles, the drive rods for the heald frames and/or the drive mechanism.

It is an object of the invention to provide a shed-forming structural component, more particularly, a heald frame or a drive rod for a heald rod for a heald frame which does not have the above mentioned draw-backs.

In order to achieve this object, the component is equipped with at least one information source or data signal provider for feeding a control unit with data about the specification of said component and/or about operating parameters of said component.

The advantage of the shed-forming component according to the invention is that the shed-forming component can be connected or coupled to a control unit, so that measured data or stored data or values determined in any other way regarding said component can be fed to a control unit, so that these data or values are known and can be used by the control unit. This means that these data or values can be converted to useful, preferably digital weaving parameters which can be used for optimising the weaving process. These data or values can, for example, also be displayed on a display of the weaving machine by means of the control unit of the weaving machine.

According to an embodiment, the component comprises at least one information source (data signal provider) which comprises a sensor with an accelerometer. Such a component provided with an accelerometer permits to determine and digitize the law of motion, the course of motion and the positions of the shed-forming components by means of a control unit of the weaving machine, more particularly, the law of motion, the course of motion and the positions of said component for each angular position of the weaving machine. As a result, the above mentioned data are directly available as parameters for determining the other settings of the waving machine, especially for comparing them to, for example, standard settings and/or for using them in calculations by a control unit for optimizing settings of the weaving machine. Digital values for the above mentioned data may be used for calculations of this kind.

According to an embodiment, the shed-forming component comprises at least one information source (data signal provider) which contains a sensor with a material stress meter, for example, a piezo crystal. According to another embodiment, the shed-forming component comprises at least one information source which contains a measuring element with a material deformation meter, for example, a series of strain gauges. Determining the mechanical load resulting from the weaving process during weaving in the form of material stress or material deformation at a relevant point of the shed-forming component and comparing the determined material stress to the maximum permissible material stress or the determined material deformation to the maximum permissible material deformation, permits a correct estimate of the load reserve or safety margin to be made. This will enable a immediate and automatic adjustment of the relevant weaving parameters, especially, it will be possible to set or adjust the weaving machine speed based on said determined material stress or material deformation. The mechanical load, which is dependent on the material stress or the material deformation of a shed-forming component, is a direct result of settings or parameters of the weaving machine, such as the shed geometry, the law of motion of the heald frames, the course of motion of the heald frames, the positions of the heald frames, the speed of the weaving machine, the warp thread density, the angular position of the weaving machine during crossing of the heald frames, the heddle dimensions, the heddle play, the warp thread tensions and other parameters. Further, an on-line feed-back control of the motion of the heald frames may be carried out. It is possible to actively influence the speed of the weaving machine or at least the speed of the heald frames for avoiding breaks or damages at the heald frames and/or their drive means. The signals of the sensors during weaving will also be dependent on the warp tension and the signals may be used to control the weaving machine such that stresses and/or deformations of the heald frames are minimized.

According to a further embodiment, the shed-forming component comprises at least one information source (data signal provider) containing an element which can generate a measureable value or an element which can deliver a measurable value.

DESCRIPTION OF DRAWINGS

The invention also relates to a weaving machine using a shed-forming apparatus containing a shed-forming component according to the invention. The invention also relates to a shed-forming component which comprises at least one actuator which is controlled by a control unit. This control unit may be arranged on the shed-forming component.

Further features and advantages of the invention are explained with reference to the enclosed drawings and an subject of the sub-claims.

DETAILED DESCRIPTION OF PREFERRED EMBODIMENTS OF THE INVENTION

Figure 1:
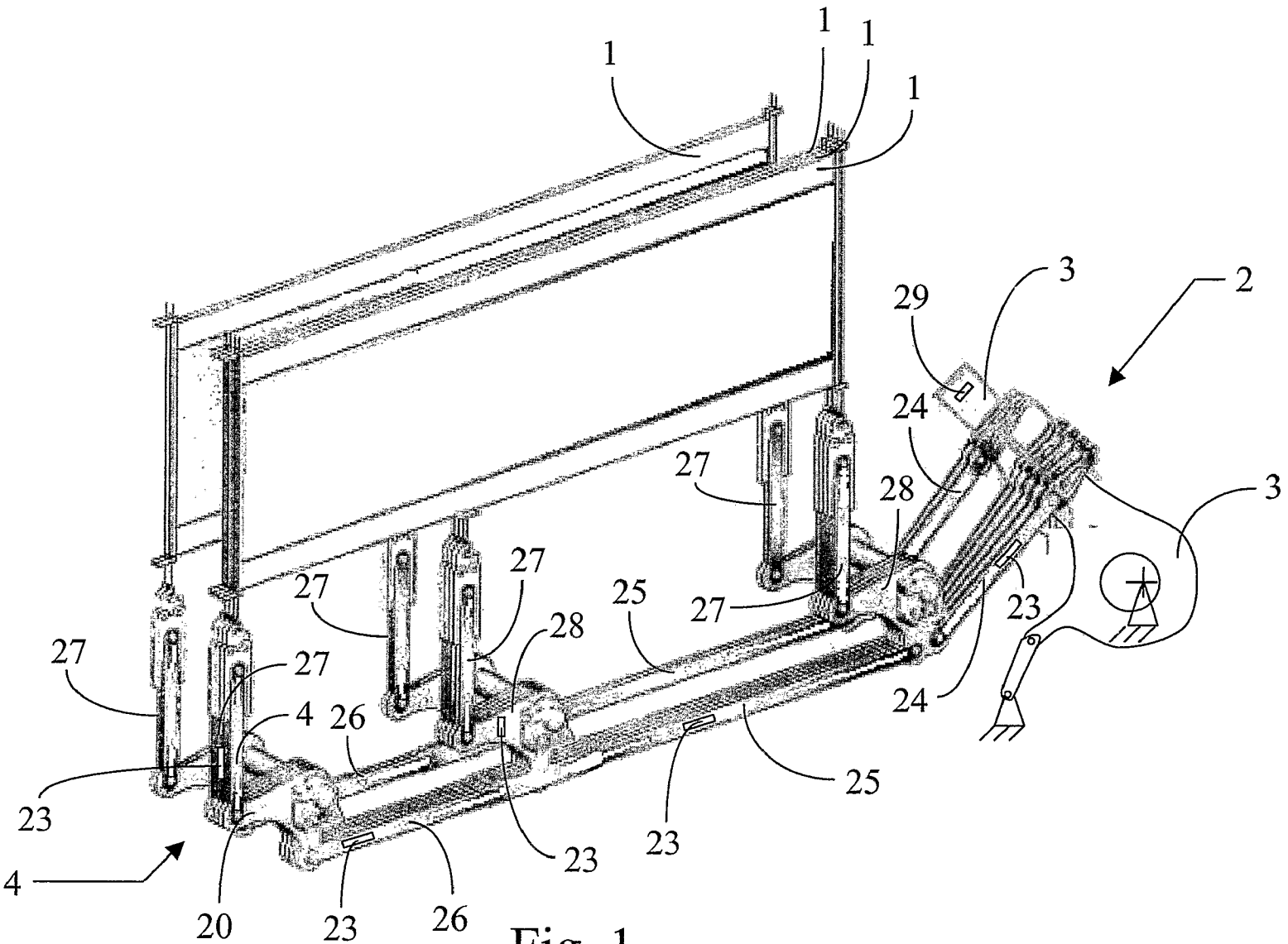
FIG. 1 schematically shows a part of a weaving machine with heald frames, drive rods for heald frames and an associated drive mechanism.

FIG. 1 illustrates a number of heald frames 1 of a shed-forming apparatus 2 containing a drive 3. The shed-forming apparatus also comprises a number of structural transmission elements 4, such as drive rods for connecting the drive 3 to an associated heald frame 1. As shown more clearly in FIG. 2, a heald frame 3 comprises a top rail 5, a first heddle bar 6 disposed near the top rail 5, a bottom rail 7, a second heddle bar 8 disposed near the bottom rail 7, and two side rails 9 and 10, both of which connect the top rail 5 and bottom rail 7. Heddles 11 are disposed between the first heddle bar 6 and the second heddle bar 8.

Figure 2:
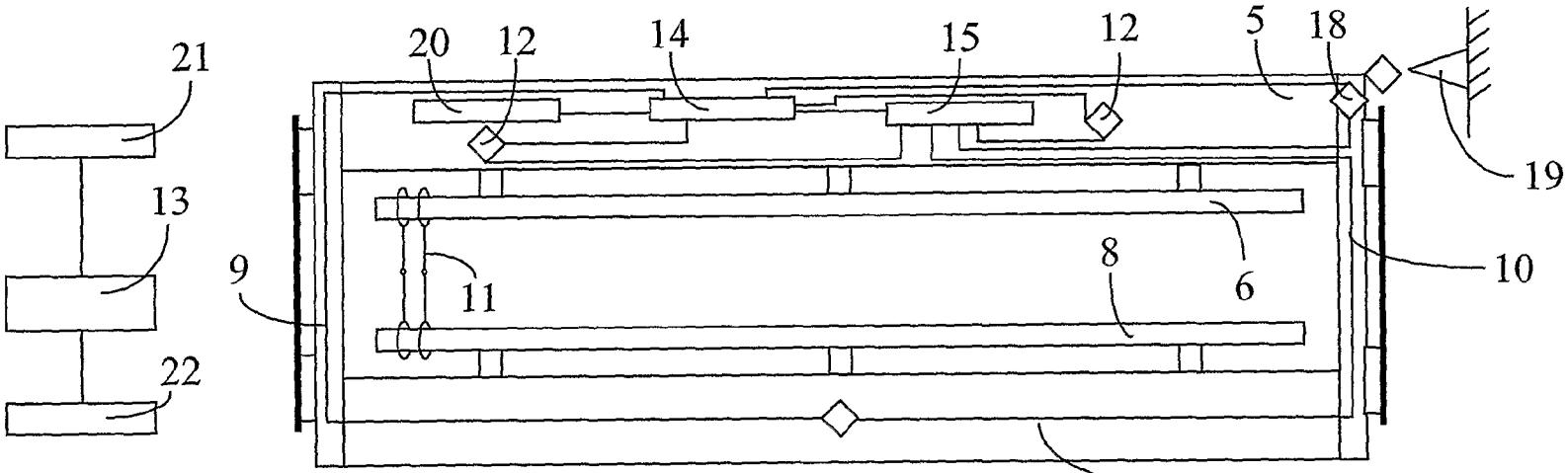
FIG. 2 shows a heald frame according to the invention.

The heald frame 1 according to the invention comprises at least one information source or data signal provider 12. In this embodiment, the heald frame 1 comprises further one signal processing unit 14 which is connected to at least one information source 12 and can be connected to a control unit 13. The control unit 13 is, for example, the control unit of the weaving machine. The information source 12 can be connected to the control unit 13 via the signal-possessing unit 14. The heald frame 1 also comprises an electrical power supply 15 for the at least one information source 12 and/or for the at least one signal processing-unit 14, which for example, is a battery. As illustrated in FIG. 2, the heald frame 1 comprises a number of information sources 12 which are all connected to the control unit 13 by means of one single signal-possessing unit 14.

According to an embodiment of the invention, the information source 12 includes a sensor, more particularly, an accelerometer which is attached to the heald frame 1 at a specific location. The signal of this accelerometer is representative of the instantaneous acceleration of the heald frame 1. From the curve of acceleration, resonance phenomena may be determined in the heald frame 1 and/or a measure for the load on the heald frame 1 may be determined. By integrating the signal of the accelerometer over time, the motion of or the law of motion of the heald frame 1 may be determined. The energy of the impact of the heddles which engage with the heald frame 1 may be determined by using the instantaneous speed of the heald frame at the moment of impact. By integrating the signal of the accelerometer twice over time, the position of the heald frame 1 and also the course of motion of the heald frame 1 may be determined. By providing several accelerometers at different locations along the heald frame 1, it will be possible to determine the movement of parts of the heald frame 1 with respect to one another or to determine the deformation of these parts of the heald frame 1. This is also advantageous for determining the resonance phenomena which occur in the heald frame 1.

Figure 3:
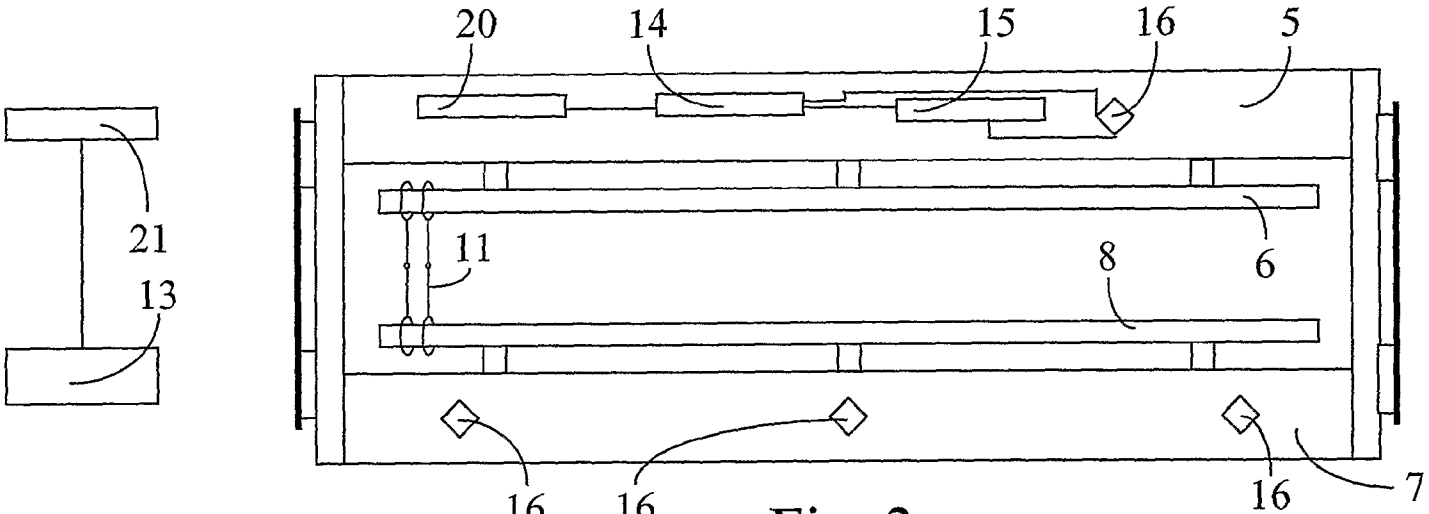
FIG. 3 shows a modification of the embodiment of FIG. 2.

The heald frame 1 of FIG. 3 comprises an information source 16 which includes a material stress meter, for example, a piezo crystal. This information source 16 generates a signal which is a function of the material stress in the heald frame 1 at the location of the material stress meter. According to the embodiment of FIG. 4, the information source 17 consists of a material deformation meter, for example, a series of strain gauges. This information source 17 allows to determine the deformation of the heald frame 1 at the location of the strain gauges. From the material deformation, the properties of the material and the geometric dimensions of the heald frame 1 at the location of the information source 17, the material stress at this location may be determined on the basis of the signals measured by the information source 17. By arranging different information sources 16 or 17 at different locations on the heald frame 1, the deformation and/or material stress at various locations of the heald frame 1 may be determined. It is advantageous to arrange information sources 16 or 17 at locations of the heald frame 1 which are most often subject to deformations and high material stresses. These locations are, for example, those where heald frames 1 usually break as a result of material loads.

The heald frame 1 may be provided with other information sources. For example, it is possible to arrange a temperature sensor as information source on the heald frame 1 in order to determine the temperature of the heald frame at the location of the temperature sensor.

The heald frame of FIG. 2 further comprises an information source 18 in the form of a proximity switch which interacts with a stationary reference point 19 of the weaving machine. Thus, it is possible to determine or to calculate the position of the heald frame 1 relative to this reference point 19 when the position of the heald frame 1 is being determined, for example, by using an accelerometer. This means, for example, establishing the reference position as the position where the stationary reference point 19 is just passed by the proximity switch.

The information sources 12, 16, 17 or 18 are arranged at specific selected and specific suitable locations of the heald frame 1. In the embodiment illustrated, these information sources 12, 16, 17 or 18 are connected to an electrical power supply 15 and/or to a signal processing unit 14. According to a preferred embodiment, the heald frame 1 also comprises a component transmitter and/or receiver 20 (which may also be referred to as a communication arrangement) which interacts with a transmitter and/or receiver 21 of the control unit 13 (also part of a communication arrangement). It is possible to transmit the signal from the information source or the signal from the sensors or the signal from the sensors after being processed by the signal-processing unit 14 to the control unit 13 in a wireless node. This may be effected, for example, by using a radio link, an infra-red beam link, an inductive link or any other link, all generally constituting a communication arrangement. The advantage is that no electrical wire connection is required between the heald frame 1 and the control unit 13, which improves the ease of handling of the heald frame 1. The entirety of the sensors, the signal-processing unit, the component transmitter and/or receiver, and/or the electrical power supply are preferably combined to form one assembly, for example, a chip which is attached to the heald frame 1. It is preferable to limit the energy consumption of the information sources 12, 16, 17, 18 and/or of the signal-processing unit 14, so that the electrical power supply 15 is not subjected to heavy load for extending the period for which the electrical power supply 15 lasts. Preferably, light-weight information sources or light-weight sensors, a lightweight processing unit 14 and a light-weight electrical power supply 15 are provided for limiting the mass added to a heald frame and the inertia forces resulting therefrom at accelerations. According to a modification each sensor is connected to its own signal-processing unit, its own electrical power supply and/or its own component transmitter and/or receiver (communication arrangement). These components are, for example, combined in a chip which is attached to the heald frame 1. In this case, a heald frame 1 comprises a number of signal-processing units 14, a number of electrical power supplies 15, a number of transmitters and/or receivers 20 and/or a number of information sources 12, 16, 17 or 18.

According to a modified embodiment (not shown) the electrical power supply 15 may comprise an electrical generator which is arranged on the heald frame 1 and which is capable of generating electrical energy. This electrical energy may be gained from the reciprocating movement of the heald frame 1 and may be stored in a storage means of the above mentioned electrical power supply 15, for example, in an electrical accumulator provided on the heald frame 1. Further, the electrical power supply 15 may consist of a system which can store energy received from an energy receiver, as for example, a light cell which is able to absorb energy from a light beam directed to it. Energy may also be transmitted by means of induction. The energy received can be stored in a storage means.

The control unit 13 can be connected to a display 22 which may display the values measured or determined by means of the information sources 12, 16, 17, and 18. The control unit 13 and the display 22 may form part of the weaving machine or may form part of a system which is separate from the weaving machine and can be connected, optionally directly, to a control unit of the weaving machine.

Figure 4:
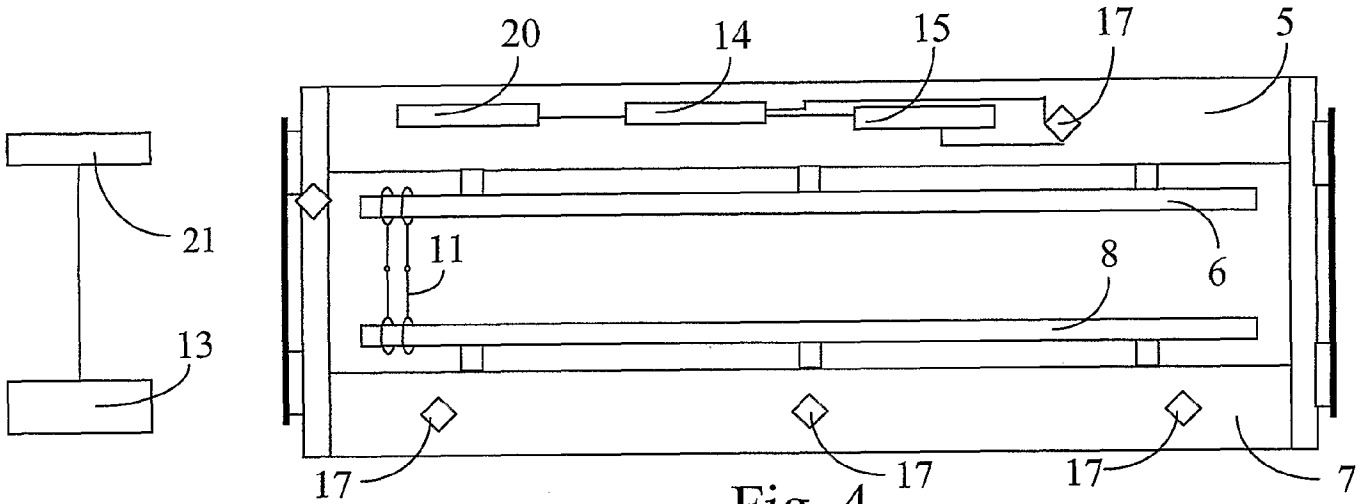
FIG. 4 shows another modification of the embodiment of FIG. 2.
Figure 5:
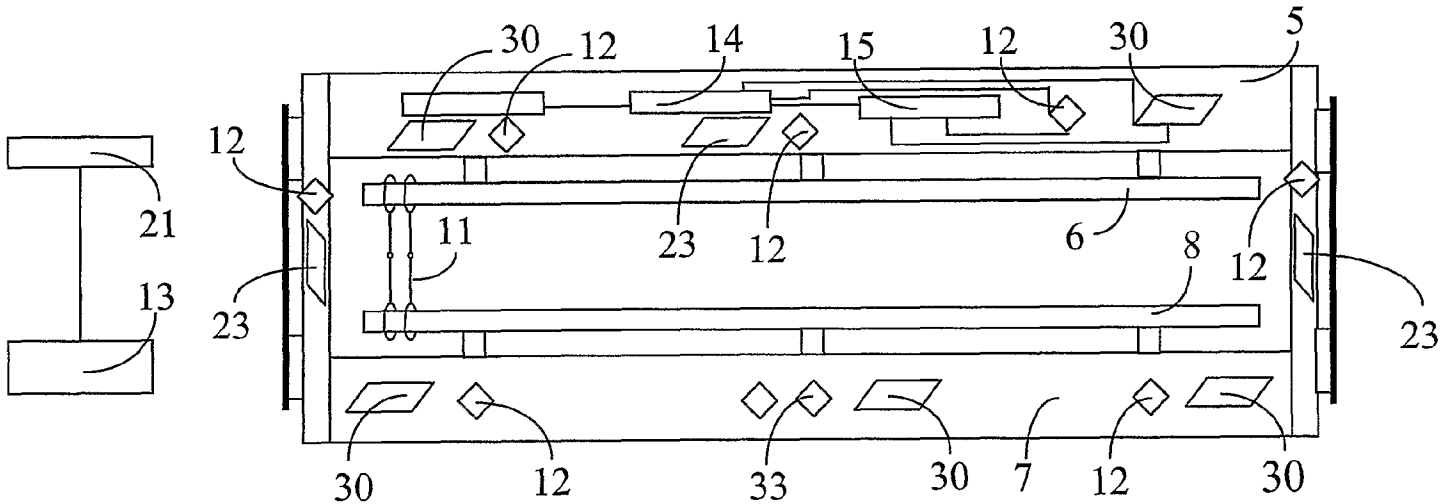
FIG. 5 shows another modification of the embodiment of FIG. 2

In the embodiments of FIGS. 3, 4 and 5, all information sources 12, 16 and 17 are connected to the signal-processing unit 14 and/or to the electrical power supply 15 in a similar way, despite the fact that for some of the information sources 12, 16, and 17, no electrical connecting lines have been shown.

As has been illustrated in FIG. 1, it is also possible to provide sensors 23, which are of similar design to one of the sensors of the information sources 12, 16, 17 or 18, on the drive rods 24, 25, 26, 27, and 28 of the transmission elements 4. Such sensors 23 may be provided on one or more of the drive rods 24 to 28. It is also possible to provide such sensors 23 on all drive rods 24 to 28. Further, sensors 29 which are of similar design to one of the sensors of the information sources 12, 16, 17, 18 or 23, may also be provided on the drive 3. The sensors 23 and 29 may be used in a similar way to the sensors of the information sources 12, 16, 17 and 18, especially, may interact in a similar way with a control unit 13, a signal-processing unit 14 and an electrical power supply 15.

Figure 6:
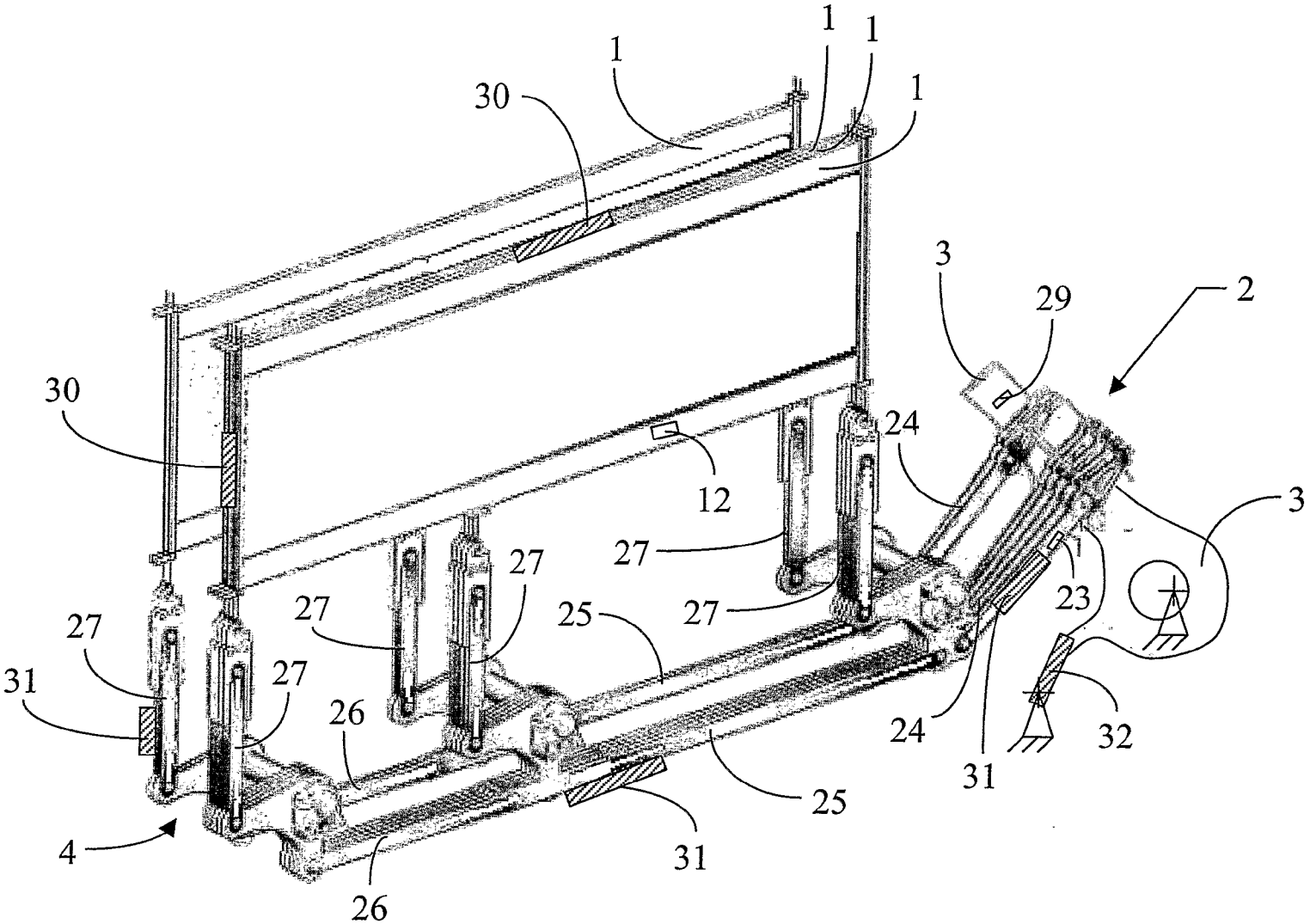
FIG. 6 shows a modification of the embodiment of FIG. 1.

According to an embodiment of the invention, the heald frame 1 comprises at least one actuator 30 or controllable element. This actuator 30 may be controlled by the control unit 13 of the weaving machine. Several of such actuators 31 may be fitted on the heald frame 1 as shown in FIG. 5. FIG. 6 also shows such actuators 30 which are fitted at the location of the top rail and a side rail of a heald frame.

As shown in FIG. 6, actuators 31 may be fitted to the transmission elements 4 and/or actuators 32 may be fitted to the drive 3. The actuators 31 may be fitted on the drive rods 24 to 28, but may also be fitted on any other element of the transmission elements 4. FIG. 6 shows a number of such actuators 31 and 32 which are fitted to or integrated in one of the drive rods 24 to 28. The actuator 31 and 32 are, for example, designed and controlled in a similar way to the actuators 30. The actuators 30 to 32 are, for example, elements which may change the resonance frequency of the component to which they are attached, for example, by being provided with electrical current or by being heated up. For example, the actuators 30 to 32 are elements which, when provided with electrical current, expand or contract—like piezo elements do—and increase or decrease the load of the component to which they are attached. The actuators 30 to 32 may be controlled by a control unit 13, based on the acceleration measured at specific locations along the associated elements, for example, at a drive rod, or based on the acceleration measured at the location of another drive rod. They may deliver a force that opposes the forces which may cause resonance in the associated drive rod 24, 25, 26 or 27. Analogously, the actuator 31 can, based on measurements, generate a suitable force at the location of the drive 3 in order to limit resonances in the drive 3.

These forces, generated by the above mentioned actuator 30, 31 or 32 fitted to the respective shed-forming component, are not speed-dependent forces, but rather are forces which are generated whenever there is a risk of a shed-forming component getting into resonance. By this, it is possible to suppress deformation of the shed-forming component due to resonance and to prevent fracturing of the shed-forming components irrespective of the speed of and the load on said shed-forming component. Moreover, it is possible to reduce the load on shed-forming components by relieving said components from resonance-forces.

Further, the invention allows to optimise a damping of the heddle of the heddle frame, which, for example, is equipped with a damping element disclosed in WO 01/48284. Especially, the distance of the damping element relative to the heddle bars 6 and 8 and relative to the heddles 11 may be adjusted in a optimum manner so that vibrations of the heald frame 1 are reduced as much as possible. Likewise, with an adjustable or inflatable damping device, as for example, disclosed in patent application DE 103 49 646 (no prior publication), filed on Oct. 21, 2003 by the applicant, the position of the damping element can be altered based on values measured using the information source 12, 16 or 17, so that vibrations of the heald frame 1 are reduced as much as possible. This means the effect of a specific adjustment on the behaviour of the heddle frame 1 may be determined instantaneously on-line and, depending on this behaviour, weaving parameters and/or adjustments may be made which positively affect the behaviour of the heald frame. Such an adjustment may be carried out on-line during weaving or during a period when the weaving is interrupted, for example, for repairing a thread or for any other reason.

Further, an information source 33 fitted on the heald frame 1 may be an identification element containing specific data (i.e. specification) about the heald frame 1. These data may be read by means of a reading unit which is connected to the control unit 13 of the weaving machine and which may be transmitted to the control unit 13. This transmission may also be effected by a transmitter and/or receiver 20 and a transmitter and/or receiver 21 or by a transmitter and/or receiver which is built into the information source 33. These data may, for example, include the material of the heald frame, the dimensions of the heald frame, the weight of the heald frame, the resonance frequency of the heald frame, the production date of the heald frame and other data relating to the heald frame. Further, it is possible by means of the control unit 13 to determine the length of time for which a specific heald frame has been used on a specific machine, for example, for determining when the heald frame should be cleaned and/or replaced.

An information source 12, 16, 17, 18, 23, 29 or 33 according to the invention may be added to any existing shed-forming component in a simple manner. An information source according to the invention may also replace an existing element fitted to a shed-forming component.

Providing an information source 12, 16, 17, 18, 23, 29 or 33 including a sensor or any other element on a heald frame 1 or an other shed-forming component which may be connected to the control unit 13 of the weaving machine, inter alia, offers the advantage that it becomes possible to directly obtain measured values of the heald frame 1 or any other shed-forming component at any moment, i.e., on-line during weaving. This makes it possible, inter alia, to determine the motion curve of the heald frame and/or the mechanical load on the heald frame. An information source 33 makes it possible, for example, to automatically adjust specific parameters of the weaving machine via the control unit 13 of the weaving machines. This information will allow to adjust the weaving speed during the operation of the weaving machine for avoiding damages at the shed-forming components. An information source 33 makes it possible, for example, to automatically adjust specific parameters of the weaving machine by means of the control unit 13 of the weaving machine. In addition, such an information source 33 makes it possible to prevent that parameters of the weaving machines will be adjusted to a specific value. For example, such an information source 33 containing the resonance frequency of a specific shed-forming component, may cause the control unit 13 to prevent that the weaving machine will be driven at a rotary speed which corresponds to that resonance frequency. The shed-forming component according to the invention may be provided with different information sources containing identification elements or sensors, for example, with both an accelerometer, a material-stress meter, a material deformation meter or any other meter which makes it possible to measure a specific parameter of the shed-forming component. Such heald frames could be referred as intelligent heald frames, i.e., heald frames of which a specific parameter may be measured or may be made available or may be calculated before or during the weaving operation.

The term information source or data signal provider does not necessarily refer to an element which may emit an electrical signal. The term information source or data signal provider also refers to an element which, when driven by an electrical signal, for example, and depending on the state of the information source, will yield a measurable value. For example, the information source or data signal provider may consist of an element with variable resistance depending on a voltage which is applied to the information source, so that when a specific voltage is applied to the information source, a current may be measured which is a function of the resistance of the information source and which may be determined by means of the signal-processing unit 14, which is independent from the information source.

According to a modification, for example, of the embodiment of FIG. 5, a control unit 13 is attached to a shed-forming component, for example, to the heald frame 1. In this case, this control unit 13 may drive the actuators 30 based on signals from the information sources 12 and 33 which are present on the heald frame 1. Then, the heald frame acts as a completely autonomous unit, i.e., independently from the control unit of the weaving machine. In this case, the actuators 30 which are arranged or integrated in the heald frame 1 may be automatically driven by a control unit which forms part of the heald frame 1 in a manner that the heald frame 1, for example, does not get into resonance. This driving may be carried out based on a signal from an information source 12 which, for example, consists of a sensor which can measure the movements of the heald frame 1. The actuators 31 and 32 arranged or integrated in a shed-forming component may be driven in a similar way by a respective control unit which is also arranged in the respective shed-forming component.

The shed-forming component and the weaving machine according to the present invention are not limited to the embodiments which are only used for describing and illustrating an example of the invention. They may be modified without leaving the scope of the invention.

The invention claimed is:

1. A shed forming apparatus for a weaving machine having a weaving machine controller, comprising a structural component that constitutes a heald frame or a motion transmitting part driving the heald frame of the shed forming apparatus; at least a first and a second data signal provider attached to and movable with the component, the first signal provider being arranged to provide electrical signals representative of stored data about the specification of said component including physical properties and/or date of manufacture of the component, the second signal provider being arranged to provide electrical signals representative of measured data about operating parameters including loading, motion, acceleration, position of the component; a signal processing and communication arrangement arranged to receive and process the signals of the first and/or the second signal provider and to transmit the processed signals to the weaving machine controller; said controller arranged to receive and relate the signals to predetermined desired operating parameters or specifications of the component and to provide a control signal usable at least by the controller to control operation of the weaving machine in a manner such that the loading and/or vibration of the component does not exceed a predetermined desired limit during weaving.

2. Shed forming apparatus as claimed in claim 1, said second signal provider comprising an accelerometer that provides an electrical signal representative of the instantaneous accelerations experienced by the component during weaving.

3. Shed forming apparatus as claimed in claim 1, said second signal provider comprising a material stress measuring device that provides an electrical signal representative of structural loads experienced by the component during weaving.

4. Shed forming apparatus as claimed in claim 1, said second signal provider comprising a material strain measuring device that provides an electrical signal representative of structural deformation experienced by the component during weaving.

5. Shed forming apparatus as claimed in claim 1, including a power source attached to and movable with the component, said power source supplying power to said first and/or said second data signal provider.

6. Shed forming apparatus as claimed in claim 1, said signal processing and communication arrangement configured to transmit the electrical signals wirelessly to said weaving machine controller, and said controller adapted to receive said electrical signals wirelessly.

7. Shed forming apparatus as claimed in claim 1, including an actuator carried by the component, the actuator operable to modify loading of the component during weaving; said actuator being controlled by said weaving machine controller in response to said electrical signals received from the first and/or second data signal provider.

8. Shed forming apparatus as claimed in claim 7, including an actuator control unit carried by the component, said actuator control unit arranged to control operation of the actuator in response to actuator control signals received from the weaving machine controller.

9. Shed forming apparatus for a weaving machine having a weaving machine controller according to claim 1, said structural component being movable during weaving in a manner imposing undesired structural loading and/or vibration on the component; an actuator attached to and movable with the structural component, said actuator being controlled by the controller in response to operating conditions of the component during weaving and being arranged to modify structural loading and/or vibration characteristics of the component during weaving in a manner that avoids undesired structural loading and/or vibration conditions of the component.

* * * * *